US005791149A

United States Patent [19]

Dean

[11] Patent Number: 5,791,149

[45] Date of Patent: Aug. 11, 1998

[54] ORIFICE PULSE TUBE REFRIGERATOR WITH PULSE TUBE FLOW SEPARATOR

[76] Inventor: William G. Dean, 6720 Steeplechase Dr., Huntsville, Ala. 35806

[21] Appl. No.: 698,176

[22] Filed: Aug. 15, 1996

[51] Int. Cl.[6] ..... F25B 9/00

[52] U.S. Cl. ..... 62/6

[58] Field of Search ..... 62/6, 467; 60/520

[56] References Cited

U.S. PATENT DOCUMENTS 5,269,147 12/1993 Ishizaki et al. ..... 62/6
5,275,002 1/1994 Inoue et al. ..... 62/6
5,335,505 8/1994 Ohtani et al. ..... 62/6
5,412,952 5/1995 Ohtani et al. ..... 62/6
5,435,136 7/1995 Ishizaki et al. ..... 60/517
5,440,883 8/1995 Harada ..... 62/6

*Primary Examiner*—Henry A. Bennett
*Assistant Examiner*—Pamela A. O'Connor
*Attorney, Agent, or Firm*—C. A. Phillips; Joseph H. Beumer

[57] ABSTRACT

An orifice pulse tube refrigerator is provided with a flow separation member in the pulse tube so as to prevent mixing of hot and cold gases from opposite end of the pulse tube, thus reducing losses due to mixing and improving efficiency. The flow separation member may take the form of a cylindrical slug of low-friction material mounted in the pulse tube for sliding movement in response to instantaneous variation in working gas pressure.

8 Claims, 1 Drawing Sheet

ORIFICE PULSE TUBE REFRIGERATOR WITH PULSE TUBE FLOW SEPARATOR

FIELD OF THE INVENTION

This invention relates generally to pulse tube refrigerators and more particularly to orifice pulse tube refrigerators.

BACKGROUND OF THE INVENTION

Pulse tube refrigeration is a variation of the Stirling cycle, and like the Stirling cycle, uses no hydrochlorofluorocarbon (HCFC) or chlorofluorocarbon (CFC) refrigerants which are being phased out owing to their harmful environmental effect of depleting the ozone layer. A typical Stirling cycle system comprises a compressor, a hot end heat exchanger, regenerator, a cold end heat exchanger, and an expander. Heat is removed from the hot end heat exchanger and absorbed at the cold end heat exchanger, thus producing refrigeration. The process is single phase in that there is no boiling or condensation, only vapor of a working gas such as helium.

Pulse tube refrigeration cycles avoid the need for an expander and obtain cooling by providing a phase shift between pressure and mass flow within the system. This has been accomplished by connecting an orifice and a reservoir to the hot end of the pulse tube. Removing the expander eliminates one moving piston, leaving only a single moving compression piston, providing for simpler and more reliable control. In addition, since the pulse tube has no moving parts at the cold end, it offers longer lifetime in cryogenic applications and eliminates vibration at the cold end. However, because of their lower efficiency, pulse tube refrigerators have not been as widely used as the classic Stirling cycle machines. Further applications of the refrigerator to commercial refrigeration requirements including those involved in food refrigerator/freezers as well as for cooling detectors and electronic components depend upon making improvements to obtain higher efficiency.

Various measures to obtain greater efficiencies in pulse tube refrigerators are disclosed in prior patents. Obtain et al., in U.S. Pat. Nos. 5,335,505, issued on Aug. 9, 1994, and 5,412,952, issued on May 9, 1995, disclose various systems including one that has two interconnected regenerators and two pulse tubes along with a plurality of valves at specified locations in the system and controlled to open and close at predetermined times, and another system arranged to provide for high-pressure coolant gas discharged from the compressor to be guided into the pulse tube through the regenerator and thence to the compressor via a reverse passageway. U.S. Pat. No. 5,275,002, issued on Jan. 4, 1994, to Inoue et al., discloses first and second spaces along with a pulse tube located between them, a driving force to establish opposite phase fluctuations of the operating fluid in the two spaces, and a phase control oscillator. Pulse tube refrigerators having both a compressor cavity and an expander cavity are disclosed in U.S. Pat. Nos. 5,269,147, issued on Dec. 14, 1993, to Ishizaki et al., and 5,435,136, issued on July 25, 1995, to the same inventors. Harada in U.S. Pat. No. 5,440,883, issued on Aug. 15, 1995, discloses a double piston pulse tube refrigerator wherein a compression piston and an expander piston are rotated between precise phase angles. Further improvements in pulse tube refrigeration efficiency are believed to be obtainable by providing a means for minimizing mixing of hot and cold gas streams within the pulse tube, by means of which energy losses have occurred in previous systems. None of the prior patents discloses placing a flow separator member within the pulse tube for this purpose.

SUMMARY OF THE INVENTION

The present invention is directed to pulse tube refrigeration systems comprising a compression means, a regenerator, a pulse tube, an orifice, and a reservoir connected in series with one another and an aftercooler heat exchanger disposed between the compression means and the input end of the regenerator, a cold end heat exchanger disposed between the output of the regenerator and the input end of the pulse tube, and a heat exchanger disposed between the output end of the pulse tube and the orifice. The combined function of the pulse tube, orifice, and reservoir is to produce a phase shift of mass flow and pressure in the system. This causes the gas to shuttle back and forth between hot and cold ends of the pulse tube. In order to minimize energy losses in the pulse tube and improve its efficiency, a flow separation member is disposed within and across the pulse tube so as to provide a free-floating object that separates hot and cold gases in the pulse tube. This flow separator increases the temperature gradient that prevails between the hot and cold ends of the tube by preventing mixing of hot and cold gases, thus reducing losses and increasing the pulse tube efficiency.

The flow separator is a free-floating cylindrical member which fits loosely inside the inside diameter of the pulse tube and which has a small mass and small inertia so as to move quickly in response to instantaneous pressure variations inside the pulse tube. Thus, it does not interfere with or appreciably change the mass flow rate and pressure phase relationship required to provide the necessary cooling effect. The flow separator is made long enough so that it does not rotate with respect to the pulse tube axis, which would cause it to bind, but rather it moves axially forward and backward inside the pulse tube. It is preferably made of a low-friction, long-wearing material so that it does not create excessive friction or drag to alter its motion as produced primarily by the prevailing pressure inside the pulse tube.

DESCRIPTION OF THE PREFERRED EMBODIMENT

Figure 1:
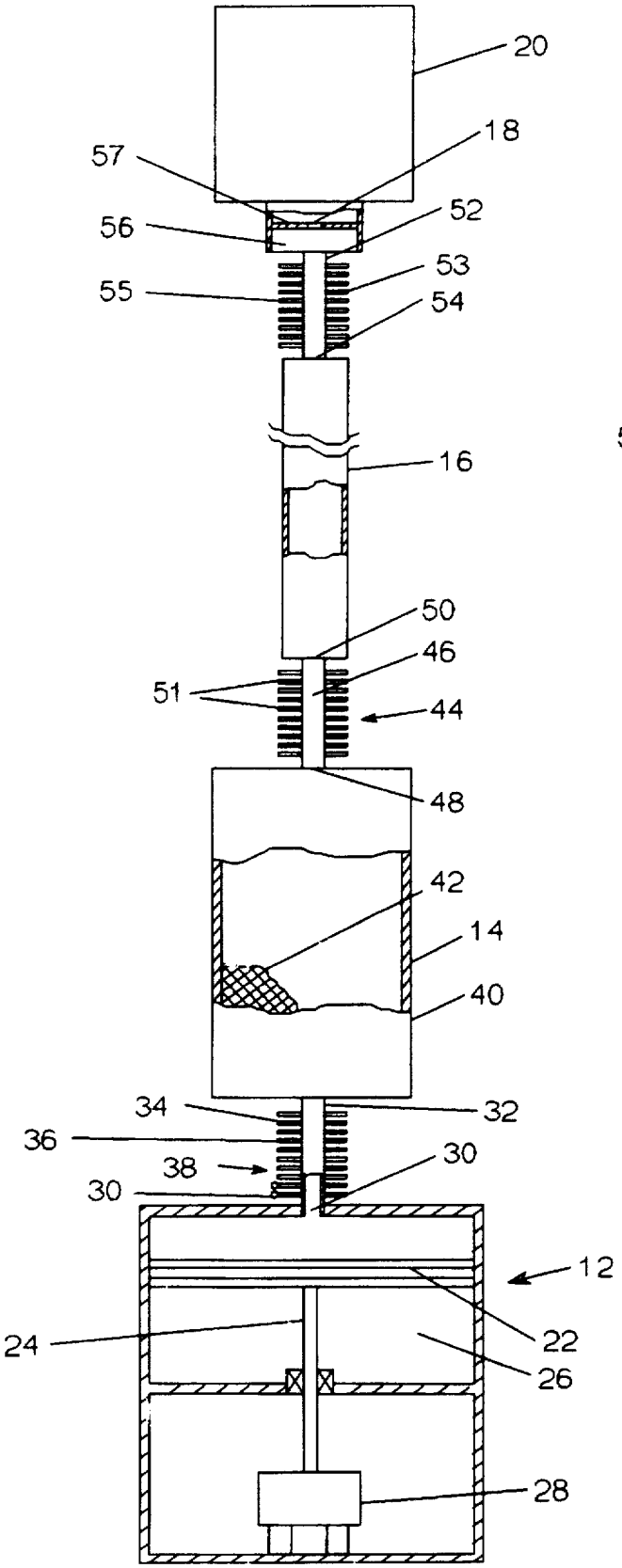
FIG. 1 is a schematic view of a pulse tube refrigeration system embodying the invention, with the flow separator removed.
Figure 3:
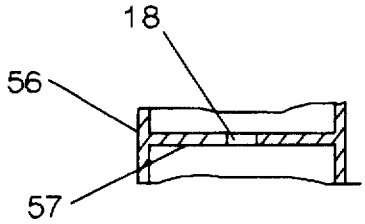
FIG. 3 is an enlarged fragmentary view of the orifice plate.

Referring to FIG. 1 of the drawings, there is shown an orifice pulse tube refrigerator. The refrigerator comprises a compressor 12, regenerator 14, pulse tube 16, orifice 18, and reservoir 20 connected in series with one another, with heat exchangers disposed between these components as required. The entire system is hermetically sealed, and the working fluid therein is pressurized to operate at a mean pressure such as 400 psi for the preferred fluid, which is helium gas. Other gases or gas mixtures may also be used.

Compressor 12 may comprise a piston 22 reciprocally movable by a rod 24 within cylinder 26. The rod 24 is in turn driven by a actuator 28. The actuator may comprise an electric motor or magnetically operated driving coils.

Discharge port 30 of compressor 12 communicates with input port 32 of regenerator 14 via tube 34 which is in thermal contact with fins 36, forming a heat exchanger 38 which functions as an aftercooler, removing heat from the working fluid. A water cooling loop may be placed in contact with the fins for more efficient removal of heat. The fins are preferably made of a highly conductive metal such as aluminum or copper.

Regenerator 14 comprises a vessel across which a plurality of heat absorbing screens 42 are disposed. The regenerator serves as an "economizer" in that it absorbs heat from the gas and conserves cooling from one cycle to the next.

Screens 42 are preferably comprised of a material with high volumetric heat capacity.

Heat exchanger 44 is placed in thermal contact with tube 46 connecting outlet port 48 of the regenerator and inlet port 50 of the pulse tube 16. Heat exchanger 44 has a plurality of fins 51 made of material such as copper or aluminum, which remove heat from the surrounding environment, producing refrigeration. To utilize the refrigeration effect, a suitable housing (not shown) would be placed to contain the environment being cooled.

Pulse tube 16 is connected to tube 46 at inlet port 50 of the pulse tube and communicates with reservoir 20 through tube 52 secured at outlet port 54 of the pulse tube. Heat exchanger 53 comprises fins 55 in thermal contact with tube 52. Cylindrical housing 56, connected to tube 52 and reservoir 20, carries a plate 57, in the center of which is defined an orifice 18. Orifice flow may be controlled by proper selection of the orifice size.

Figure 2:
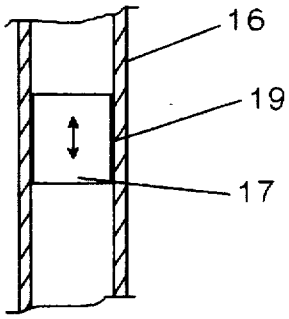
FIG. 2 is an enlarged fragmentary view of a pulse tube and flow separator incorporated therein.

As shown in FIG. 2, a flow separator 17 is disposed within pulse tube 16 for reciprocating sliding motion therein in response to variations in gas pressure. The flow separator, which may take the form of a cylindrical slug, is sized so as to provide a gap 19 between it and the inside diameter of the pulse tube, allowing free-floating movement. The slug may preferably be comprised of a low-friction, long-wearing material. Teflon™ also known as polytetrafluoroethylene, is suitable for this purpose. As shown in the drawing, the length of the slug is preferably greater than its diameter to prevent rotation.

Heat exchangers which remove heat from the fluid, that is, heat exchangers 38 and 53, may be enhanced in operation by inclusion of a water cooled loop of conventional design.

Although the invention has been shown and described with reference to a specific embodiment, it is not limited to details of the illustrated structure, and changes and modifications may be made without departing from the scope of the appended claims.

I claim:

1. A pulse tube refrigeration system comprising:

compressing means for compressing a working fluid;

first heat removal means connected with the compressor means;

regenerating means connected with the first heat removal means;

refrigerating means connected to the regenerating means;

a pulse tube connected at a first end thereof to said refrigerating means and at an opposite end connected to a second heat removal means and adapted to contain pressurized working fluid moving reciprocally within the tube;

orifice means comprising a housing connected to said second heat removal means and an orifice defined in said housing for passing of working fluid therethrough;

reservoir means communicating with said orifice; and said pulse tube having disposed therein a flow-separating means whereby mixing of gases from opposite sides thereof is prevented and energy losses are thereby minimized.

2. A refrigerating system as defined in claim 1 wherein said flow separating means comprises a cylindrical slug slidably mounted in said pulse tube.

3. A refrigerating system as defined in claim 2 wherein said slug comprises a low-friction, long-wearing material.

4. A refrigerating system as defined in claim 3 wherein said material is polytetrafluoroethylene.

5. A refrigerating system as defined in claim 3 wherein said slug has a diameter such as to provide a gap between the slug and wall of said pulse tube.

6. A refrigerating system as defined in claim 5 wherein said slug has a length at last greater than the inside diameter of said pulse tube.

7. In a pulse tube refrigerating system comprising a compressor, a regenerator, a pulse tube, an orifice, and a reservoir connected in series with one another, an aftercooler heat exchanger disposed between said compressor and said regenerator, a cold end heat exchanger disposed between the output of the regenerator and the pulse tube, and a heat-removing heat exchanger disposed between the pulse tube and the orifice and wherein a working gas is caused to shuttle back and forth between opposite ends of the pulse tube, the improvement which comprises a flow separation member disposed within and across the pulse tube so as to prevent mixing of hot and cold gases therein.

8. The improvement as defined in claim 7 wherein said flow separation member is a slidably mounted cylindrical slug of low-friction, long-lasting material.

* * * * *